United States Patent [19]

Teodorescu

[11] 4,019,834

[45] Apr. 26, 1977

[54] GAS EXTRACTION APPARATUS FOR THERMAL INSTALLATIONS

[75] Inventor: Constantin Teodorescu, Bucharest, Romania

[73] Assignee: Institutul National Pentru Creatie Stintifica si Technica, Bucharest, Romania

[22] Filed: May 23, 1975

[21] Appl. No.: 580,329

[30] Foreign Application Priority Data

May 23, 1974 Romania ..... 78906

[52] U.S. Cl. ..... 417/84; 417/155; 417/197; 417/198

[51] Int. Cl.[2] ..... F04F 5/20

[58] Field of Search ..... 417/155, 156, 157, 197, 417/54, 84, 89, 198, 55, 87

[56] References Cited

UNITED STATES PATENTS

| | | | |
|---|---|---|---|
| 629,019 | 7/1899 | Thomas | 417/155 |
| 705,713 | 7/1902 | Smith | 417/155 |
| 1,942,048 | 1/1934 | Clark | 417/197 |
| 2,164,880 | 7/1939 | Merkt | 417/155 |

FOREIGN PATENTS OR APPLICATIONS

| | | | |
|---|---|---|---|
| 1,099,520 | 3/1955 | France | 417/89 |

*Primary Examiner*—William L. Freeh
*Assistant Examiner*—Edward Look
*Attorney, Agent, or Firm*—Karl F. Ross; Herbert Dubno

[57] ABSTRACT

Hot gases from a furnace or the like are fed to a core or inner tube that terminates at its downstream end at the upstream end of a larger-diameter mixing tube. A jacket surrounding the inner tube is formed with a plurality of compartments which are of increasing cross-sectional area toward the downstream end of the inner tube. A blower is connected to the upstream ends of the compartments or branches or the jacket and the downstream ends of these compartments are connected to a annular nozzle defined between the outside of the inner tube and the inside of the mixing tube. Thus air in the compartments is heated by the hot gases in the inner tube and expand so as to issue from the nozzle at high speed and entrain the gases in the inner tube in jet-pump fashion.

1 Claim, 4 Drawing Figures

GAS EXTRACTION APPARATUS FOR THERMAL INSTALLATIONS

FIELD OF THE INVENTION

The present invention relates to a method of and apparatus for displacing a hot gas. More particularly this invention concerns a system useful for entraining and venting hot exhaust gases to the atmosphere.

Background of the Invention

Systems are known for extraction of gas from combustion apparatuses which accelerate these gases directly at the combustion device by placing a ventilator in the path of the gases as they leave the burner or the like. This system has the considerable disadvantage that, because of the high temperatures of these fumes, the ventilator parts wear out rapidly. In addition ducts for the very hot fumes must be cooled by water or the like in order to prolong their service life.

It is also known to use a ventilator located outside the hot-gas exhaust ducts which deliver air under pressure into the chimney by means of a duct provided with an ejector. In this case the service life of the ventilator is increased considerably, but the device has the disadvantage that part of the chimney is blocked by the ejector which introduces the air into the trajectory or path of the fumes. This blockage becomes larger with time as inevitably chemicals in the dirty exhaust gases cling to the ejector and therefor increase its size.

Another type of device is known which increases the draft for the exhaust fumes by means of a ventilator located out-side the chimney that delivers air under pressure to a shaft at the upper end of the chimney shaped as a venturi so as to aspirate and entrain the fumes to the exterior. Such a jet-type of system is found to be relatively inefficient, as the energy necessary to displace a quantity of air sufficient to entrain the exhaust gas is very high.

Objects of the Invention

It is therefore an object of the present invention to provide an improved method of and apparatus for entraining the hot gas and venting same to the atmosphere.

Another object is the provision of an improved method and apparatus of this type which simultaneously cools the hot gas.

Summary of the Invention

These objects are attained according to the present invention in a method wherein the heat contained in the hot gas is used in part to drive the system, the remaining heat being afterwards given up to the air delivered under pressure by a blower through a spaced formed between a jacket and the outer surface of the central tube or duct in whcih the hot-gas passes. The jacket is subdivided into a plurality of branches which lie in heat-exchange relationship with the outside of the central hot-gas tube and are, relative to the axial direction of flow of the hot gas in the inner tube and of the flow of air in these branches created by the blower, of increasing cross section. The branches are joined to one another at their downstream ends in a compartment which tapers in the downstream direction and is formed at its downstream end with a nozzle opening at the downstream end of the inner tube to a mixing tube or duct where the air injected by the blower and the hot gas are turbulenced together.

Thus according to the present invention the heat in the exhaust gas in the inner tube passes through the wall of this tube to the gas filling the branches of the jacket so as to heat this air and increase it volume and an enthalpy. The increase in volume of the air injected by the blower therefore increases its pressure and makes for a very powerful and effective jet at the nozzle which serves, jet-pump fashion, to entrain the hot gases in the inner tube. Simultaneously as the gases in the inner tube give up heat the temperature of these gases decreases as does the volume and, therefore, the pressure. This decrease in pressure in the hot gases in the central or inner tube creates a great deal of turbulence at the nozzle so that the mixing in the outlet tube of the device is complete and relatively cool gases will issue from the top of the chimney.

The device according to the present invention therefore has an inner or aspiration tube having an upstream end connected to a source of hot gas. A jacket surrounds at least part of this inner tube and is formed with a compartment that increases in cross-sectional size along the inner tube toward a nozzle formed at the downstream end of both the compartment and the inner tube. A mixing duct is provided at the downstream end of the inner tube and the nozzle opens into this mixing duct. A blower has an outlet side connected to the upstream end of the jacket compartment so that the air forced into this compartment by the blower will be heated and expanded by heat exchange from the inner tube and issue at high velocity from the nozzle into the mixing duct.

According to another feature of this invention the jacket is subdivided into a plurality of such compartments and is provided at its downstream end with a distribution chamber and at its upstream end with another chamber or compartment that tapers in the downstream direction and is in turn provided at its downstream end with the nozzle that is of annular shape and opens along the inner wall of the mixing duct.

The system according to the present invention has several advantages. First of all the tube or duct for the fumes is in not way obstructed by a central ejector or a fan of the ventilator and the possibility of this obstruction growing as foreign matter settles on the obstruction is also eliminated. The chimney is protected from the high temperature of the fumes of the exhaust gases because these gases cool considerably by mixing with ambient air. The jet-pump action according to the present invention creates a considerable low-pressure zone that very effectively draws the hot gases up the chimney.

BRIEF DESCRIPTION OF THE DRAWING

The above and other objects, features and advantages will become more readily apparent from th following, reference being made to the accompany drawing in which.

SPECIFIC DESCRIPTION

Figure 1:
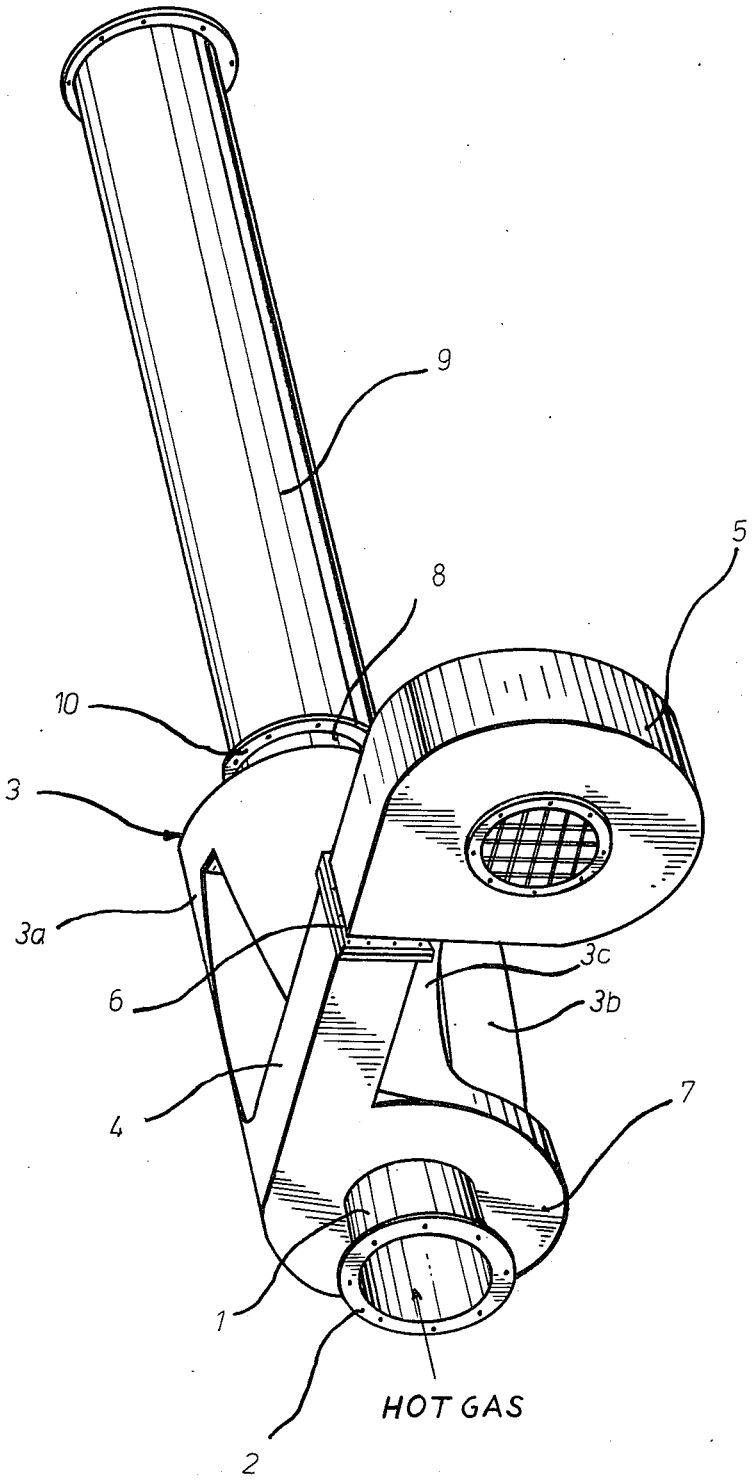
FIG. 1 is a perspective view of an apparatus functioning according to the method of the present invention.
Figure 2:
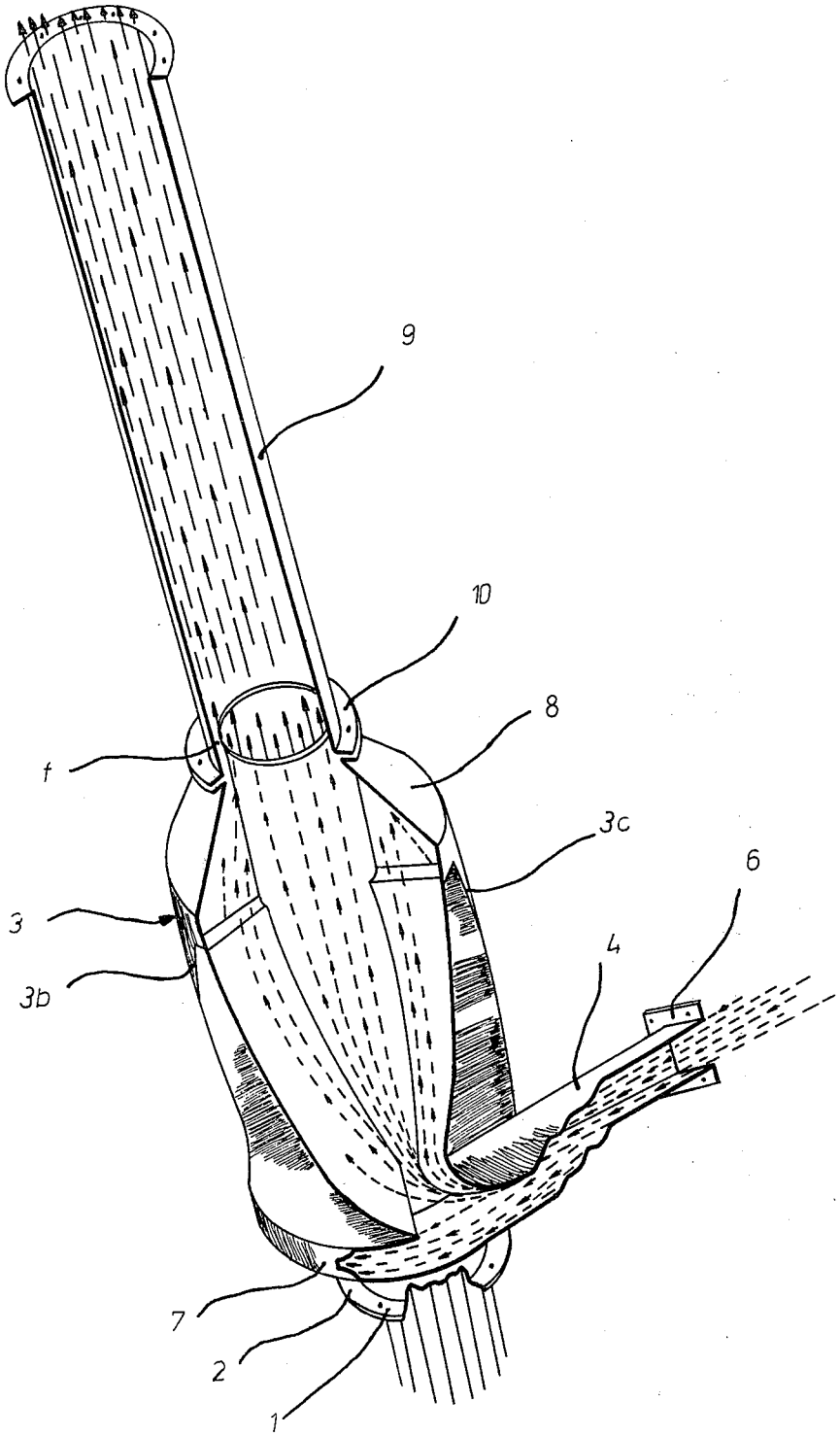
FIG. 2 is a view similar to FIG. 1 but partly broken away.
Figure 3:
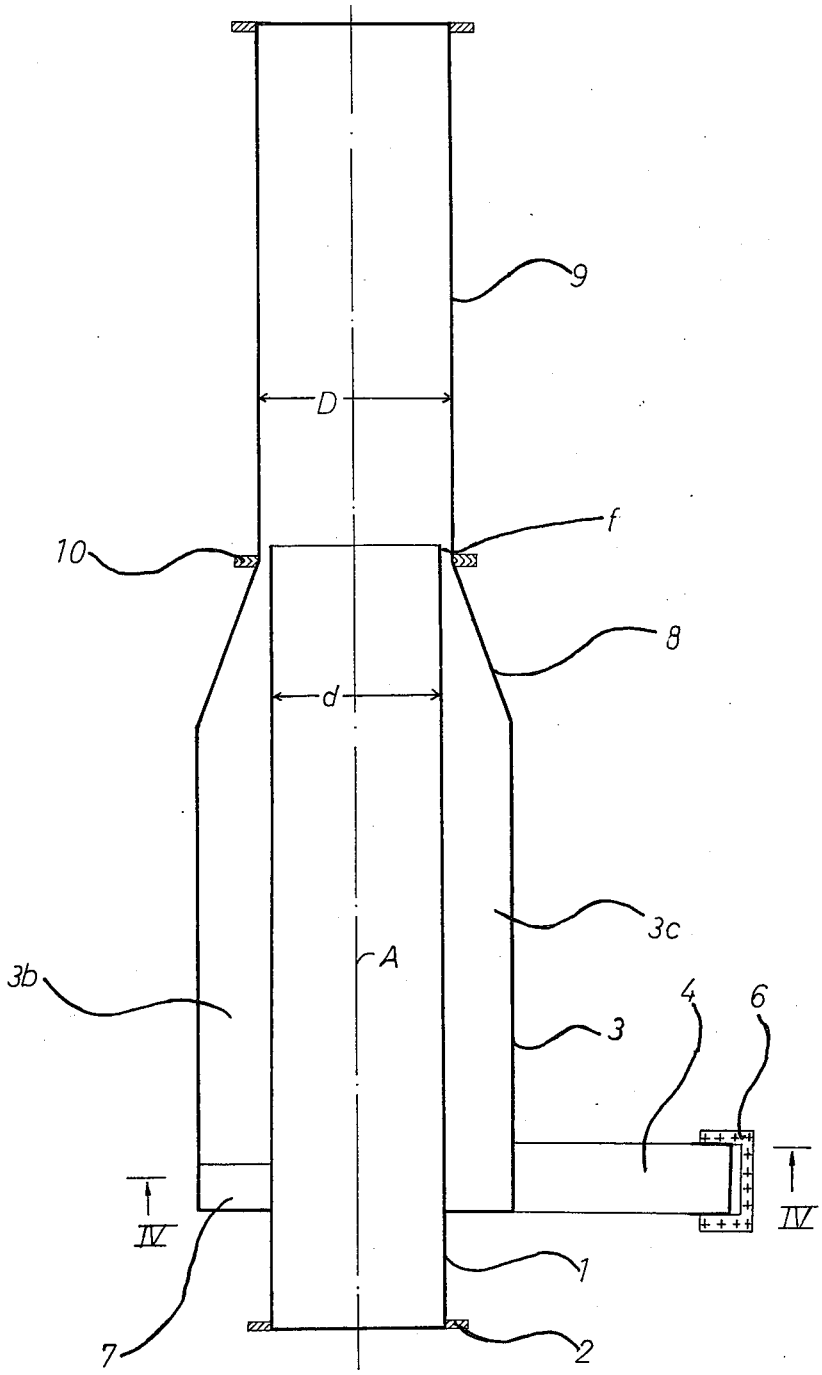
FIG. 3 is a longitudinal section through the apparatus of FIG. 1.
Figure 4:
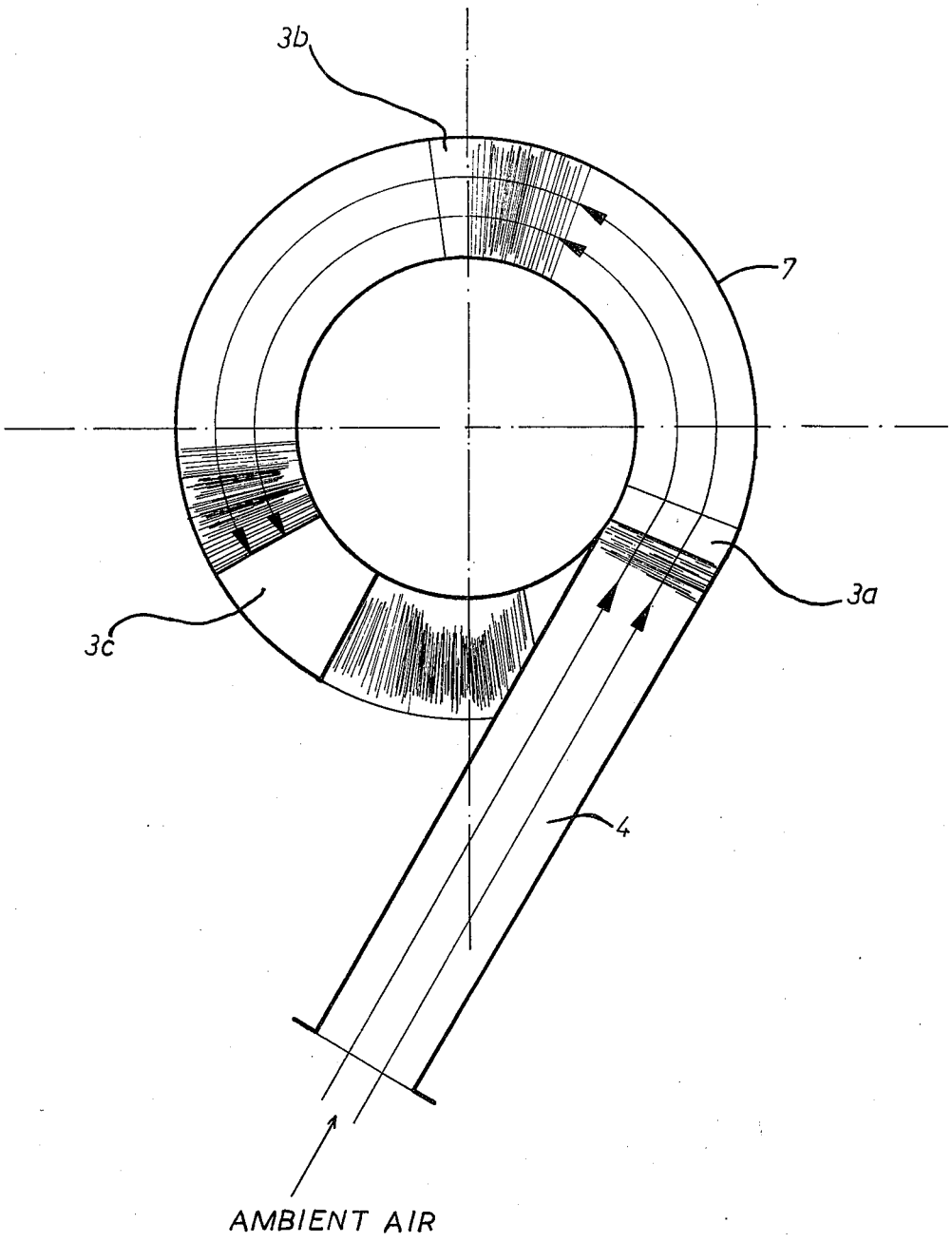
FIG. 4 is a section taken along line IV—IV of FIG. 3.

The device according to the invention is centered in an inner or aspiration tube 1 connectable by means of a flange 2 to a source of hot gas such as a furnace or the like. The tube 1 is generally cylindrical and made of heat-conducting metal. It defines an upright axis A and has an outer diameter *d* (see FIG. 3).

A jacket 3 is carried on the aspiration tube 1 and is divided into three branches or chambers 3*a*, 3*b*, and 3*c* which are connected through a conduit 4 to an axial-input radial-output blower 5 by means of a flange 6.

The conduit 4 from the ventilator 5 is connected to the branches 3*a*–3*c* of the jacket 1 by a scroll-type manifold 7 which is wrapped around the downstream or lower end of the tube 1 and is of the same cross-sectional area as the conduit 4 up to the branch 3*a*, then it is stepped down and proceeds to the branch 3*b*, and then it is stepped down again and terminates at the downstream end of the branch 3*c*. Each of the branches 3*a*–3*c* is of increasing cross-sectional area in the direction of axial flow of air from the ventilator 5 and the inside wall of each of the branches 3*a*–3*c* is constituted by the tube 1.

The branches 3*a*–3*c* are joined at their wide downstream ends at a chamber 8 of axially tapered or frustoconical shape and terminating at a circularly annular nozzle opening *f* at the extreme upstream end of the mixing duct 9 which is secured to the chamber 8 by means of a flange 10. This duct or tube 9 is coaxial with the tube 1 and has an inner diameter D greater than the ouer diameter *d* of the tube 1 so as to define the ring-like gap *f*. The mixing tube 9 either constututes part of or is connected to the chimney of the installation.

The device functions as follows:

Fumes, hot gas and the like are conducted to the aspiration tube 1, entering this tube at a high temperature. Heat transfer is effected through the walls of the tube 1 with air in the chambers 3*a*–3*c* by the blower 5. The effect of this is to increase the specific volume and temperature of the air in the branches 3*a*–3*c* so as simultaneously to increase the enthalpy of this air.

On the other hand the temperature of the hot gases in the aspiration tube 1 decreases, their specific volume decreases, and the weight rate of the burning products increases.

The weight rate of the air must keep at the same level both in the slot section or nozzle *f* and in the branches 3*a*–3*c*. Thus as the specific volume increases in these branches due to the caloric contribution the volumetric flow increases and the speed in the slot *f* also increases.

This action creates a low-pressure zone in the aspiration tube 1 which is proportional to the speeds realized in the slot *f*. The air exits at high speed from the slot *f* and thereby entrains, jet-pump fashion, the air rising in the tube 1. Due to the difference in pressures between the air issuing in the gap *f* and rising in the tube 1 there is considerably turbulence and the two fluids mix thoroughly. This action lowers the temperature of the gas in mixing duct 9 so that it can be conducted up the chimney without damaging this chimney or creating a pollution problem.

I claim:

1. An apparatus for treating a hot gas, said apparatus comprising:

an elongated constant-cross section tube having an inlet end for receiving said hot gas and an outlet end downstream therefrom;

a jacket extending axially along said tube forming at a plurality of elongated compartments arranged around and extending along said tube and in heat-exchange relationship with said tube, said compartments each being of increasing cross-sectional dimension toward said outlet end but terminating short thereof;

an inwardly converging shell extending from said compartments and defining an annular nozzle slot opening downstream and at said outlet end of said tube;

a constant-cross section mixing duct at said outlet end surrounding said outlet end and said nozzle;

blower means for forcing air into the upstream end of said compartment, whereby said air is heated in said compartment and issues under pressure from said nozzle slot to suck said hot gas from said tube;

an annular inlet manifold communicating with the upstream ends of said compartments adjacent said inlet end of said tube and extending only over a part of the length of said tube at the inlet end thereof; and a tangential conduit opening into said manifold and connecting said manifold with said blower means, said jacket and said shell extending substantially over the entire length of said duct.

* * * * *